US005657491A

United States Patent [19]

Young

[11] Patent Number: 5,657,491

[45] Date of Patent: Aug. 19, 1997

[54] CAP HAVING REMOVABLE ADJUSTMENT STRAP AND SUPPORT PANEL

[76] Inventor: Stephen A. Young, 9803 Fairway Ridge Rd., Charlotte, N.C. 28277

[21] Appl. No.: 527,923

[22] Filed: Sep. 14, 1995

[51] Int. Cl.[6] ..... A42B 1/22

[52] U.S. Cl. ..... 2/195.2; 2/195.5

[58] Field of Search ..... 2/181, 181.6, 182.1, 2/182.3, 182.6, 183, 195.2, 195.1, 195.4, 195.5

[56] References Cited

U.S. PATENT DOCUMENTS

| | | | |
|---|---|---|---|
| 1,857,574 | 5/1932 | Sykora | 2/195.4 |
| 2,684,485 | 7/1954 | Rossman | 2/195.2 |
| 5,003,640 | 4/1991 | Pizzarcar | 2/195.2 |
| 5,239,704 | 8/1993 | Cornelio et al. | 2/195.2 |
| 5,282,278 | 2/1994 | Miner | 2/195.1 |
| 5,287,559 | 2/1994 | Christiansen et al. | 2/181 |
| 5,359,733 | 11/1994 | Brannon et al. | 2/195.1 |
| 5,428,844 | 7/1995 | Dougherty | 2/181 |
| 5,454,120 | 10/1995 | Rowlands | 2/195.1 |
| 5,481,760 | 1/1996 | Wood, Jr. | 2/181.6 |

*Primary Examiner*—C. D. Crowder
*Assistant Examiner*—Larry D. Worrell, Jr.
*Attorney, Agent, or Firm*—Adams Law Firm, P.A.

[57] ABSTRACT

A cap includes a cap band defining a cap base, and a crown is attached to the cap band. The crown has a front portion and a back portion. First and second spaced-apart tabs are attached respectively to the cap band at the front portion of the crown. The tabs include respective fastener members. A removable adjustment strap is located between the first and second tabs, and includes complementary fastener members at opposite ends thereof for being mated with the fastener members of the first and second tabs. The front portion of the crown defines an open area thereof adjacent to the first and second tabs and adjustment strap for permitting ready attachment and removal of the adjustment strap by the wearer. A bill is attached to the back portion of the crown opposite the adjustment strap, and resides adjacent to a back of the wearer's neck during cap wear.

13 Claims, 8 Drawing Sheets

CAP HAVING REMOVABLE ADJUSTMENT STRAP AND SUPPORT PANEL

TECHNICAL FIELD AND BACKGROUND OF THE INVENTION

This invention relates to a cap. The invention resembles the appearance of a conventional cap, and includes features enabling the cap to be comfortably worn in its intended position on the head of a wearer with a bill of the cap located adjacent to the back of the neck. The invention is constructed of any suitable material, such as wool, cotton, nylon, polyester, or the like.

Presently, it has become quite popular among many people, particularly teenagers, to wear conventional-type baseball caps in a reverse manner as described above with a bill of the cap positioned adjacent to the back of the neck. Due to the particular construction of the cap, this manner of wear is generally uncomfortable and awkward. The normally sloping back portion of a conventional cap is not properly shaped to fit comfortably against the forehead of the wearer. In addition, many caps have size adjustment straps which are intended to reside against the back of the head of the wearer when the cap is worn in a conventional manner. These straps are typically formed of a semi-rigid plastic material, and are uncomfortable against the skin of the forehead when the cap is worn in a reverse manner.

In addition to comfort considerations, conventional caps generally provide a logo, advertisement, or other insignia only on a front portion of the crown adjacent to the bill. Consequently, the logo, advertisement, or insignia is not readily viewed and displayed with the cap worn in a reverse manner. The back portion of a conventional cap opposite the bill does not have a generally upstanding shape, and does not provide an adequate display area.

The present invention addressed these and other problems associated with wearing conventional, baseball-type caps in a reverse manner by providing a cap which is specifically intended to be worn in this manner with a bill of the cap positioned adjacent to the back of the neck. The present cap is comfortable, and properly shaped to fit the head of the wearer. The invention resembles the appearance of a conventional cap, and provides a greater front display area on the crown for displaying a desired logo, advertisement, or other insignia.

SUMMARY OF THE INVENTION

Therefore, it is an object of the invention to provide a cap which is intended to be worn in a reverse manner on the head of a wearer with a bill of the cap residing adjacent to the back of the neck.

It is another object of the invention to provide a cap which is comfortable to wear in its intended position on the head of a wearer.

It is another object of the invention to provide a cap with a slightly expandable cap band to provide a better and more secure fit.

It is another object of the invention to provide a cap which receives and absorbs perspiration moisture from the forehead of the wearer.

It is another object of the invention to provide a cap with a removable and interchangeable size adjustment strap located at a front crown portion of the cap for residing against the forehead of the wearer.

It is another object of the invention to provide a cap wherein the adjustment strap is relatively wide to more comfortably reside against the forehead of the wearer.

It is another object of the invention to provide a cap wherein the adjustment strap is relatively long to provide greater surface area for displaying indicia, such as a trademark or other written material.

It is another object of the invention to provide a cap wherein the front portion of the crown opposite the bill remains in a generally upstanding condition during wear.

These and other objects of the present invention are achieved in the preferred embodiments disclosed below by providing a cap. The cap includes a cap band defining a cap base. A crown is attached to the cap band, and includes a front portion and a back portion. Size-adjustment means including first and second spaced-apart tabs are attached respectively to the cap band at the front portion of the crown. The tabs include respective fastener members. A removable adjustment strap is located between the first and second tabs, and includes complementary fastener members at opposite ends thereof for being mated with the fastener members of the first and second tabs.

The front portion of the crown defines an open area thereof adjacent to the first and second tabs and adjustment strap for permitting ready attachment and removal of the adjustment strap by the wearer. A bill is attached to the back portion of the crown opposite the adjustment strap, and resides adjacent to a back of the wearer's neck during cap wear.

According to one preferred embodiment of the invention, the fastener members of the first and second tabs include a respective plurality of nubs, and the complementary fastener members of the adjustment strap include a corresponding plurality of holes.

According to another preferred embodiment of the invention, the width of the adjustment strap is between 1–2 inches.

According to yet another preferred embodiment of the invention, the length of the adjustment strap is between 5–7 inches.

According to yet another preferred embodiment of the invention, the adjustment strap is formed of a durable and flexible plastic material.

According to yet another preferred embodiment of the invention, a comfort barrier is attached to an inside surface of the adjustment strap for residing against the forehead of the wearer during cap wear.

According to yet another preferred embodiment of the invention, the comfort barrier is formed of a moisture-absorptive fabric material.

Preferably, the moisture-absorptive fabric material is terry-knit cotton.

According to another preferred embodiment of the invention, a relatively stiff support panel is located adjacent to the front portion of the crown on an inside surface thereof for supporting the front portion in a generally upstanding position during cap wear.

According to another preferred embodiment of the invention, the relatively stiff panel is formed of an open-mesh polyester fabric.

According to yet another preferred embodiment of the invention, the cap band includes elastic yarns for permitting slight stretching thereof to increase the comfort of the cap during wear.

According to another preferred embodiment of the invention, the cap includes a cap band defining a cap base, and a crown attached to the cap band. The crown has a generally upstanding front portion shaped to fit against the forehead of a wearer and a generally sloping back portion. The front portion of the crown defines a relatively flat display surface for displaying a logo. Size-adjustment means including first and second spaced-apart tabs are attached respectively to the cap band at the front portion of the crown. The tabs include respective fastener members. A removable adjustment strap is located between the first and second tabs, and includes complementary fastener members at opposite ends thereof for being mated with the fastener members of the first and second tabs.

The front portion of the crown defines an open area thereof adjacent to the first and second tabs and adjustment strap for permitting ready attachment and removal of the adjustment strap by the wearer. A bill is attached to the back portion of the crown opposite the strap opening, and resides adjacent to a back of the wearer's neck during wear.

According to one preferred embodiment of the invention, an angle defined between the cap bill and the front portion of the crown is between 90–110 degrees.

According to another preferred embodiment of the invention, an angle defined between the cap bill and the back portion of the crown is between 120–140 degrees.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
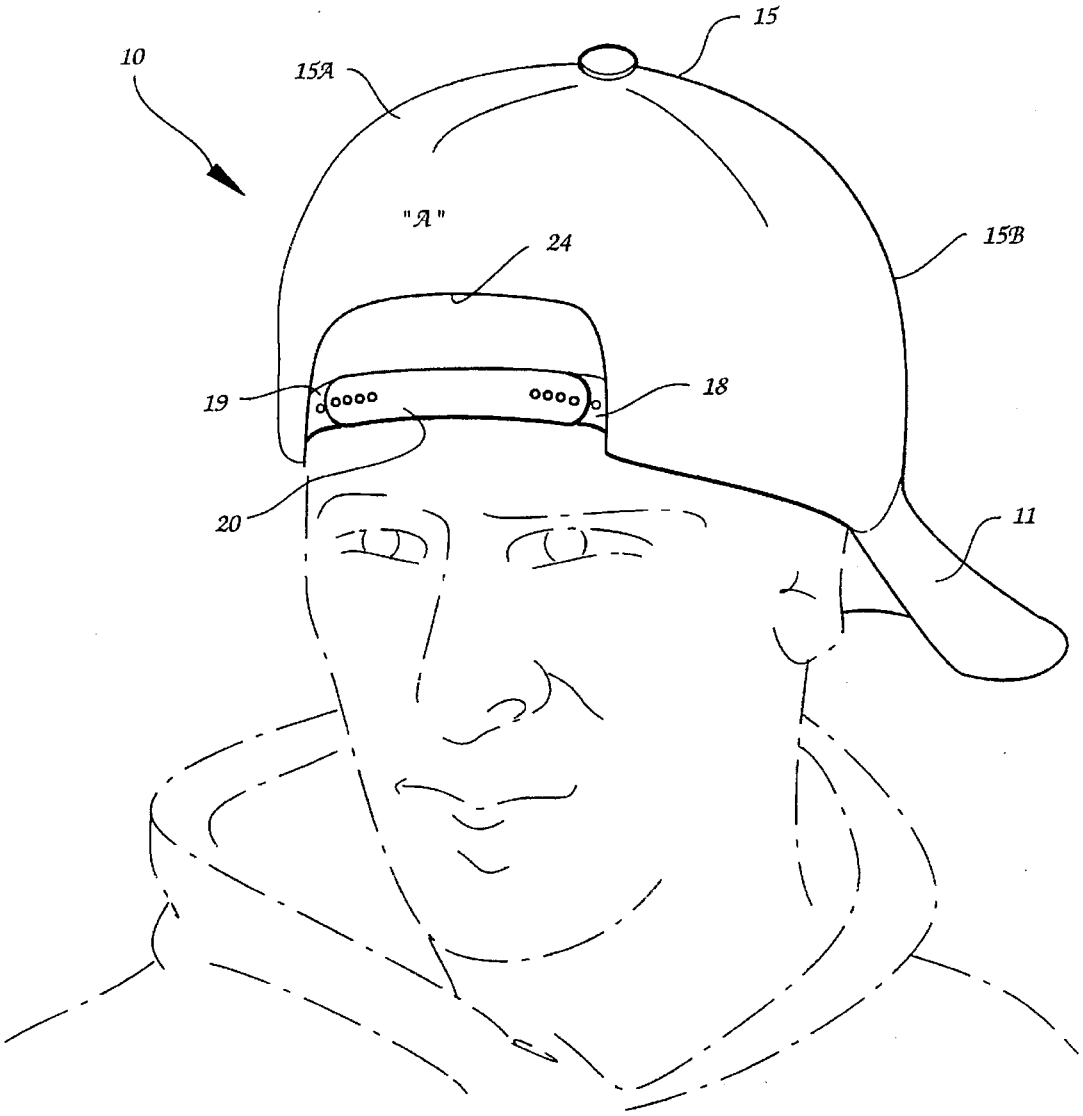
FIG. 1 is a perspective view of a cap according to one preferred embodiment of the invention, and showing the cap worn in its intended position on the head of a wearer.
Figure 2:
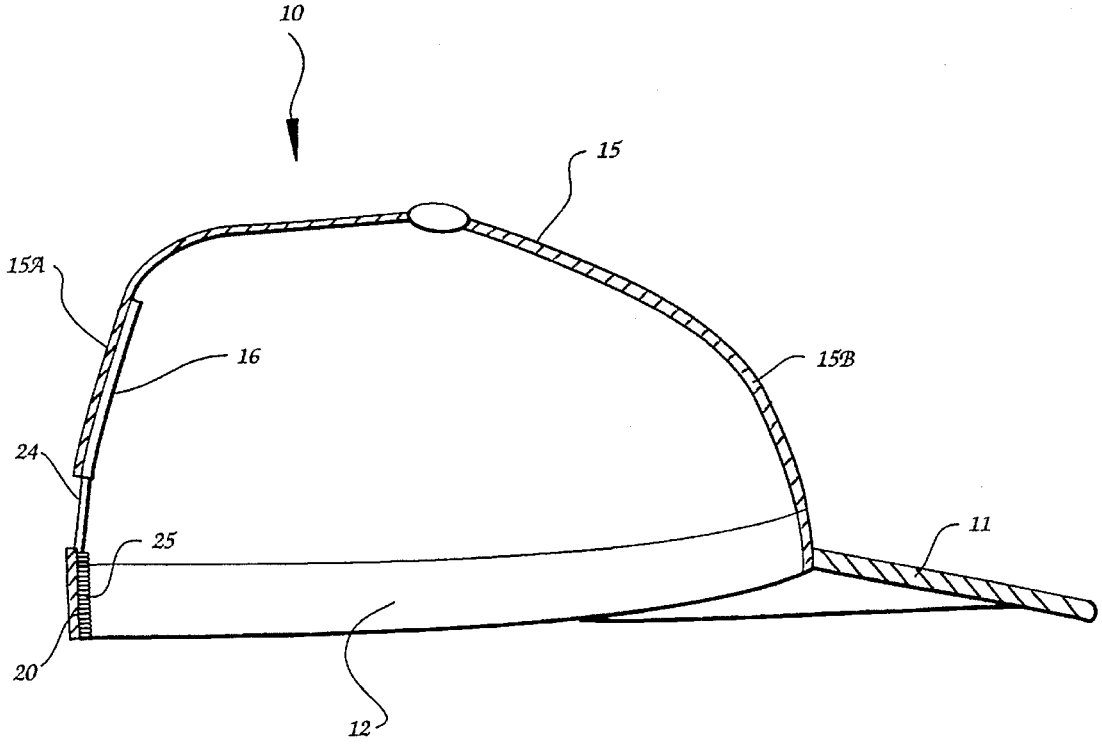
FIG. 2 is a cross-sectional side view of the cap illustrated in FIG. 1 taken substantially along a lengthwise dimension thereof.

Referring now specifically to the drawings, a cap according to the present invention is illustrated in FIG. 1 and shown generally at reference numeral 10. Although the cap 10 resembles a conventional cap in many respects, it includes features described below enabling the cap 10 to be comfortably worn in its intended position on the head of a wearer, as shown in FIG. 1, with a bill 11 of the cap 10 located adjacent to the back of the neck. The cap 10 is constructed of any suitable material such as wool, cotton, nylon, polyester, or the like.

Referring to FIGS. 2–5, the cap 10 includes a band 12 defining an inside cap base, and a crown 15 having a generally upstanding front portion 15A and a sloping back portion 15B. The front portion 15A of the crown 15 provides a relatively large and flat display area "A" for displaying a logo, insignia, or other advertisement (not shown).

Figure 3:
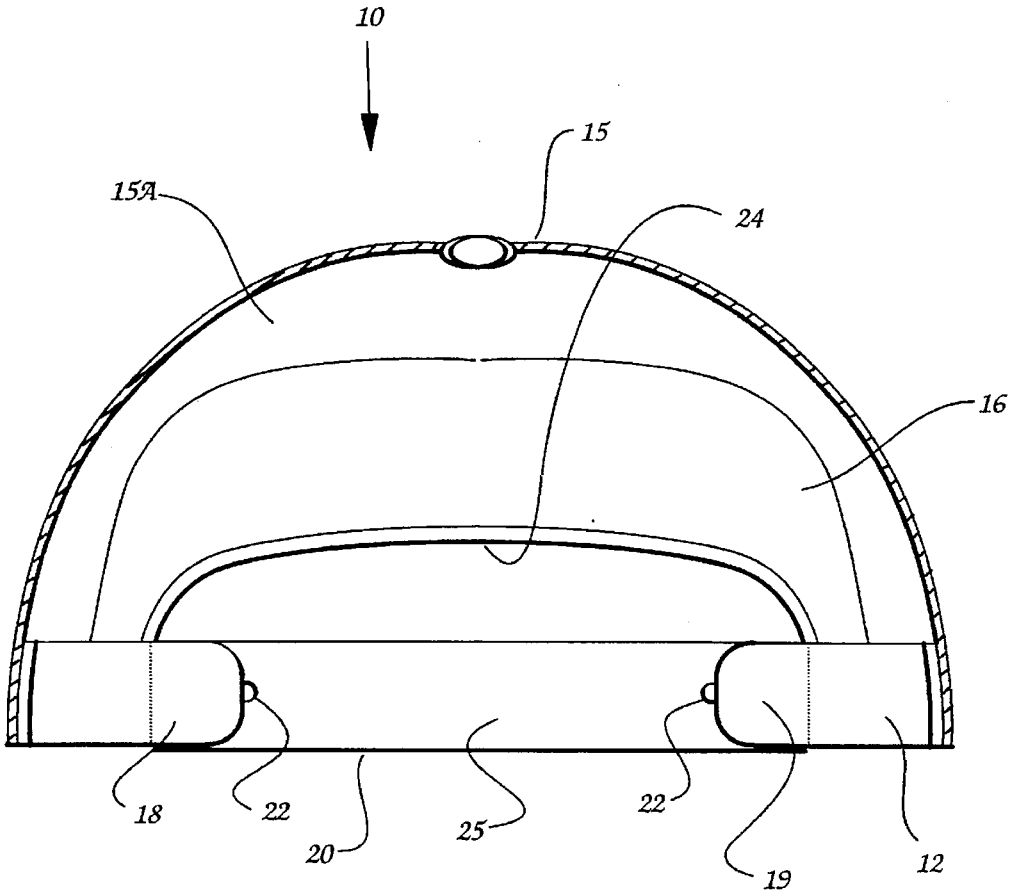
FIG. 3 is a cross-sectional view of the cap taken substantially along a widthwise dimension thereof, and showing an inside front portion of the crown.
Figure 4:
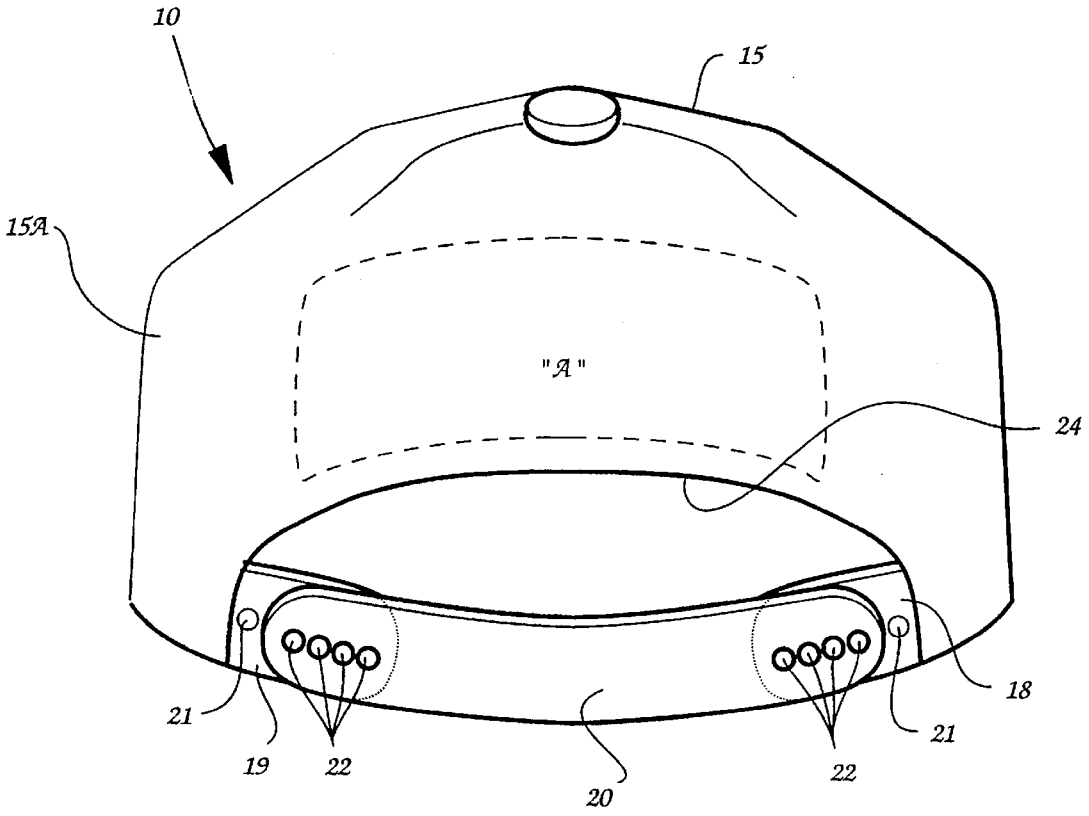
FIG. 4 is a front perspective view of the cap showing the relatively large display area for displaying a logo, advertisement, or other insignia on a front crown portion of the cap.

As best shown in FIG. 3, a relatively stiff support panel 16 is attached to the band 12, and located adjacent to an inside surface of the crown front portion 15A to maintain the front portion 15A in its upstanding position during cap wear. The support panel 16 may be sewn along its perimeter to the inside surface of the crown 15, or attached solely to the band 12. According to one embodiment, the support panel 16 is formed of an open-mesh polyester material such as that commonly used in conventional caps.

Figure 5:
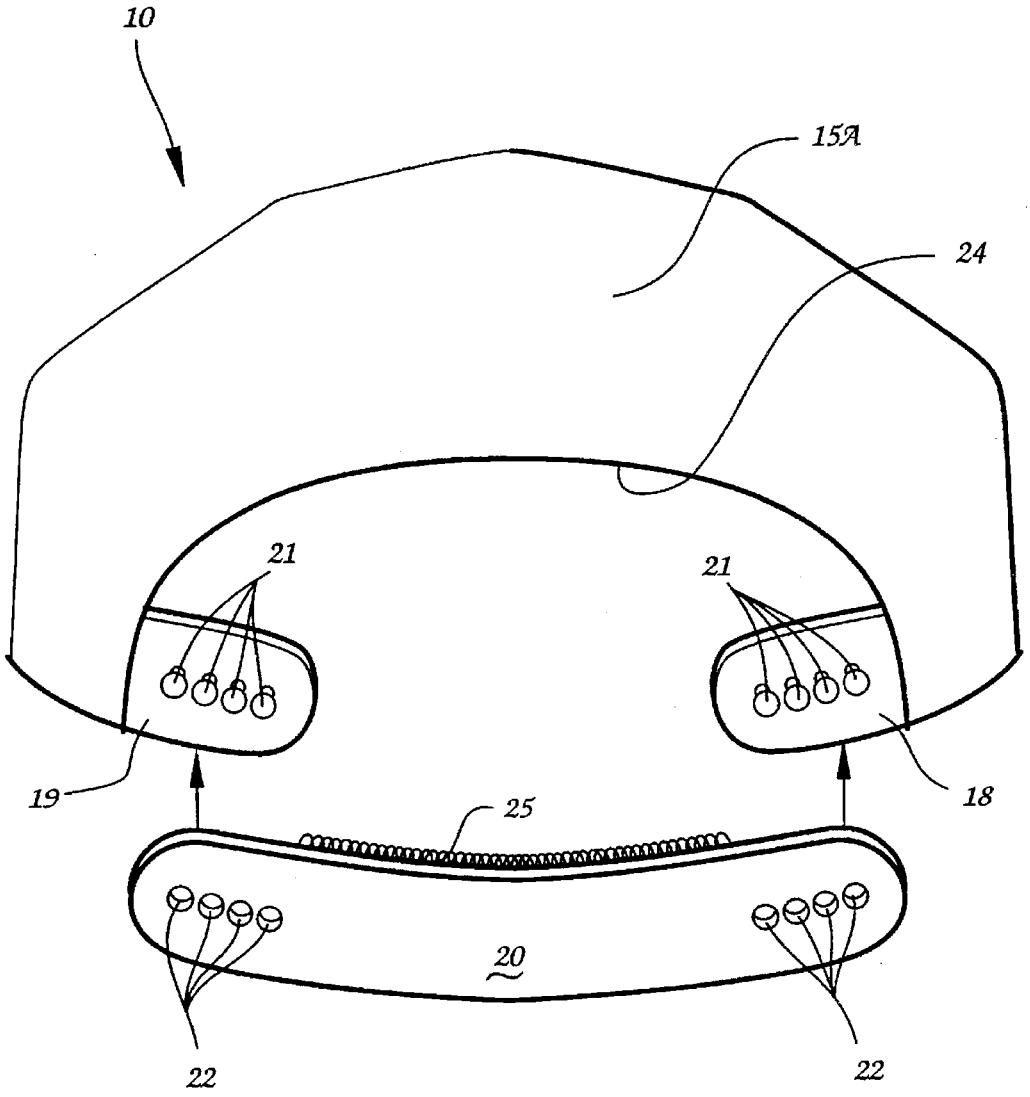
FIG. 5 is an enlarged, fragmentary perspective view of the cap showing particularly the attachment of the adjustment strap to the first and second tabs.

The cap 10 further includes first and second spaced-apart tabs 18 and 19, and a removable adjustment strap 20 for adjusting the size of the cap 10. The tabs 18 and 19 are attached to the cap band 12 beneath the front display area "A", and include a number of fastener members 21, such as projecting nubs, for being mated with complementary fastener members 22, such as holes formed at respective opposite ends of the removable adjustment strap 20. The adjustment strap 20 is attached to the cap 10 in one of several releasably locking positions to adjust the circumference of the cap band 12 as desired by the wearer. The removable attachment of the strap 20 to the tabs 18 and 19 is best illustrated in FIG. 5. In an alternative embodiment, standard hook and loop fasteners or complementary snap fasteners are provided for removably attaching the strap 20 to the tabs 18 and 19.

Preferably, the strap 20 and tabs 18 and 19 are formed of a durable plastic or fabric material, and are approximately 1–2 inches wide to fit comfortably against the forehead of the wearer. The length of the strap 20 is approximately 5–7 inches, and provides a relatively large area for displaying indicia, such as a trademark or other written material. The strap 20 can be readily removed from the cap 10 by the wearer and interchanged with a like strap to display alternative indicia. In addition, a comfort liner 25 may be located on the inside surface of the strap 20 for residing against the forehead of the wearer to provide a soft barrier between the strap 20 and the skin. The comfort liner 25 is preferably formed of a terry-knit cotton fabric, and further serves to absorb perspiration moisture from the forehead of the wearer during cap wear.

A generally arcuate shaped cut-out 24 is provided at the front portion 15A of the crown 15 adjacent to the tabs 18, 19 and adjustment strap 20 to provide an open area for allowing ready attachment and removal of the adjustment strap 20 by the wearer. The length of the cut-out 24 preferably corresponds to the length of the adjustment strap 20.

Figure 6:
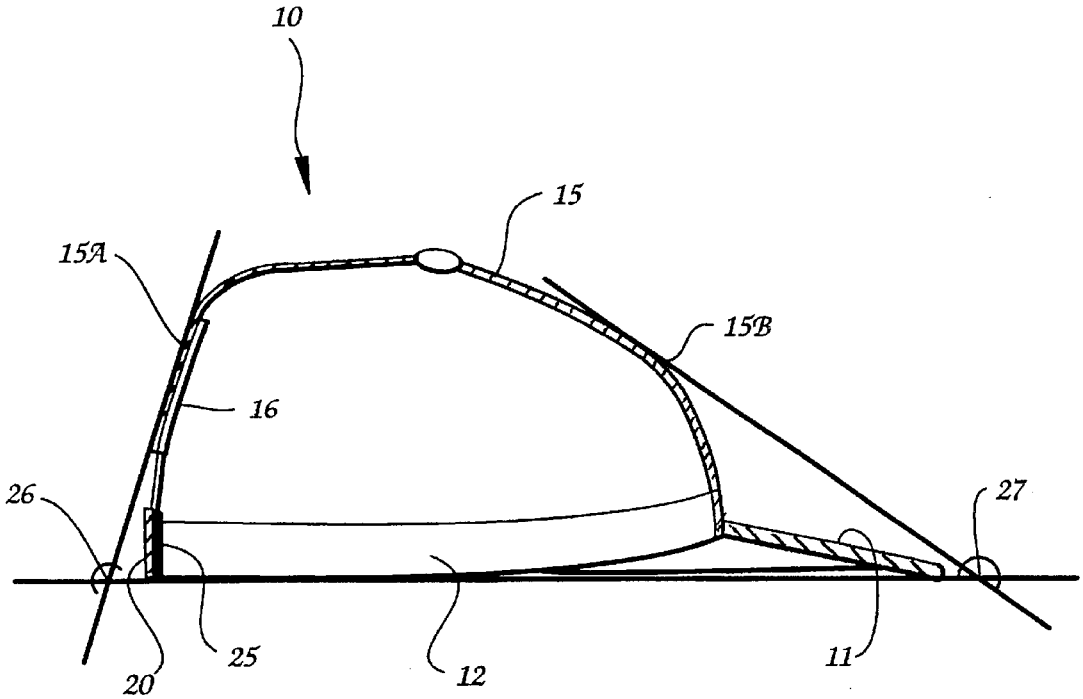
FIG. 6 is a cross-section view of the cap showing the approximate angles of the front and back portions of the crown relative to the bill of the cap.

The approximate angles of the front portion 15A and back portion 15B of the crown 15 relative to the bill 11 are best illustrated in FIG. 6. The angle 26 defined by the slope of the front portion 15A and the bill 11 is preferably between 90–110 degrees. The angle 27 defined by the slope of the back portion 15B and the bill 11 is preferably between 120–140 degrees.

Figure 7:
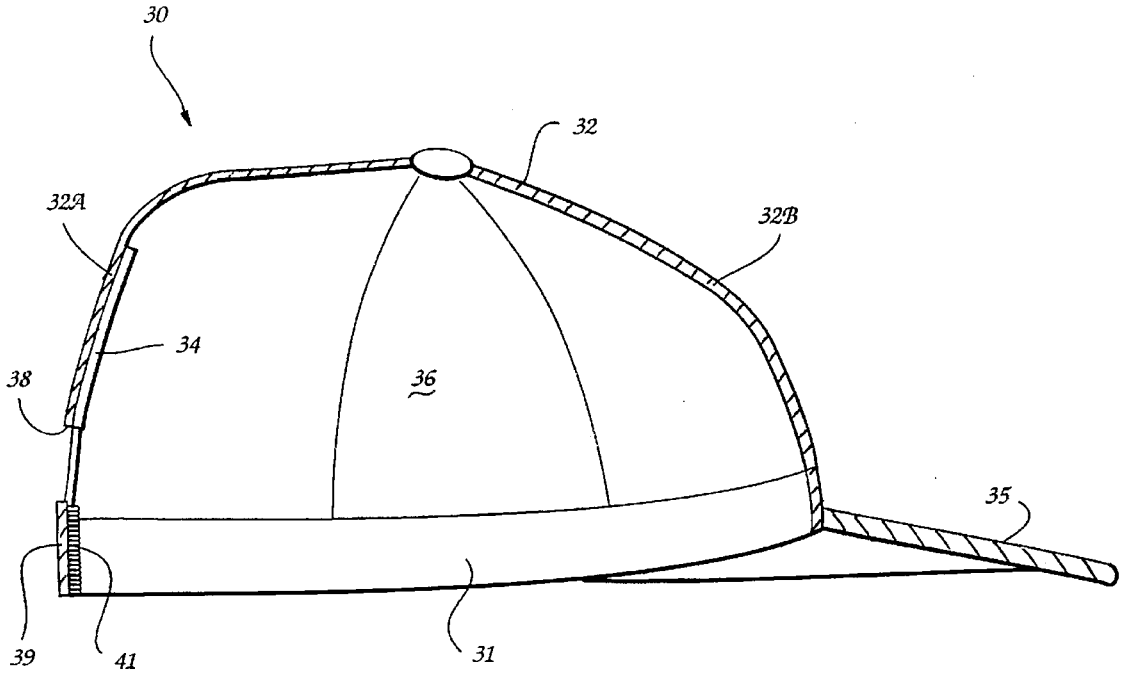
FIG. 7 is a cross-sectional side view of the cap according to a second preferred embodiment of the invention.
Figure 8:
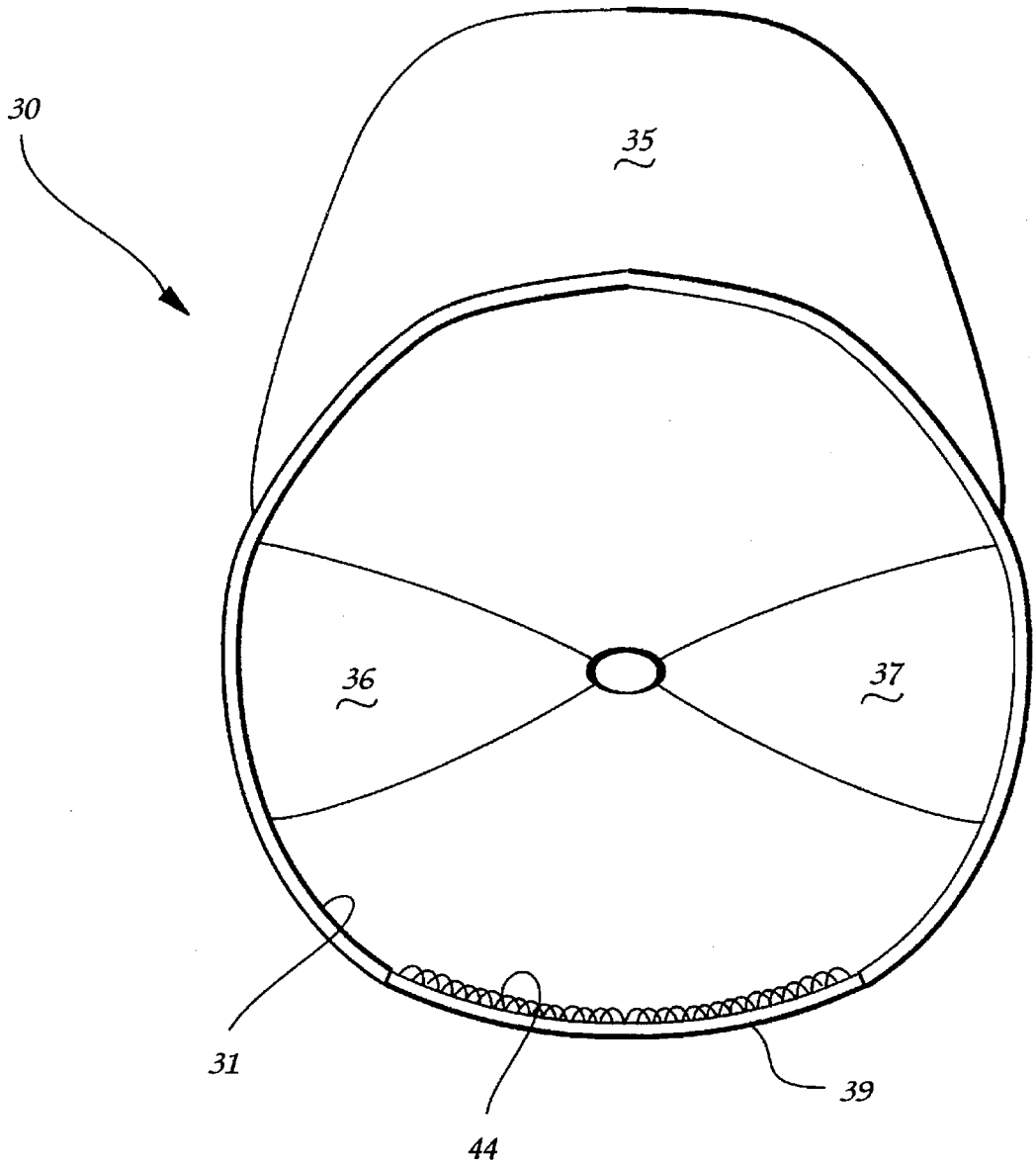
FIG. 8 is a plan view showing the interior of the cap illustrated in FIG. 7.

A second embodiment of the cap 30 is illustrated in FIGS. 7 and 8. The cap 30 includes an annular band 31 defining an inside cap base, and a crown 32 having a generally upstanding front portion 32A and a sloping back portion 32B. A relatively stiff support panel 34 is attached to the band 31, and located adjacent to an inside surface of the front portion 32A to maintain the front portion 32A in its upstanding position during wear. A bill 35 is attached to the back portion 32B of the crown 32, and resides adjacent to the back of the neck of the wearer during cap wear.

The crown 32 of the cap 30 includes opposing side panels 36 and 37. The side panels 36 and 37 are constructed of an elastic material, such as "Spandex", and permit slight stretching of the crown 32 during wear to provide a more secure fit of the cap 30 on the head of the wearer. The annular band 31 of the cap 30 likewise includes elastic yarns for allowing slight stretching of the cap base during wear.

In addition, the cap 30 further includes a cut-out 38 defining open area in the front portion 32A of the crown 32, and a fixed strap 39 attached to the cap band 31 and extending from one side of the open area to the opposite side of the open area. The fixed strap 39 is preferably formed of a fabric material, and may include a comfort liner 41, as previously described, for residing against the skin of the forehead. Alternatively, the fixed strap 39 may be an integrally formed section of the cap band 31.

A cap is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A cap comprising:

(a) a cap band defining a cap base;

(b) a crown attached to said cap band, and including a front portion thereof and a back portion thereof;

(c) size-adjustment means comprising first and second spaced-apart tabs attached respectively to the cap band at the front portion of said crown and including respective fastener members, and a removable adjustment strap located between the first and second tabs and including complementary fastener members at opposite ends thereof for being mated with the fastener members of the first and second tabs; and (d) the front portion of said crown defining an open area thereof adjacent to the first and second tabs and adjustment strap for permitting ready attachment and removal of the adjustment strap by the wearer;

(e) a support panel located adjacent to the front portion of the crown on an inside surface thereof for supporting the front portion in a generally upstanding position during cap wear, and having an arcuate bottom edge portion thereof residing adjacent to the open area formed in the front portion of said crown; and (f) a bill attached to the back portion of said crown opposite the adjustment strap, and residing adjacent to a back of the wearer's neck during cap wear.

2. A cap according to claim 1, wherein the fastener members of the first and second tabs comprise a respective plurality of nubs, and the complementary fastener members of the adjustment strap comprise a corresponding plurality of holes.

3. A cap according to claim 1, wherein the width of the adjustment strap is between 1–2 inches.

4. A cap according to claim 3, wherein the length of the adjustment strap is between 5–7 inches.

5. A cap according to claim 1, wherein the adjustment strap is formed of a durable and flexible plastic material.

6. A cap according to claim 5, and including a comfort liner attached to an inside surface of the adjustment strap for residing against the forehead of the wearer during cap wear.

7. A cap according to claim 6, wherein said comfort liner comprises a moisture-absorptive fabric material.

8. A cap according to claim 7, wherein said moisture-absorptive fabric material comprises terry-knit cotton.

9. A cap according to claim 1, wherein said panel is formed of an open-mesh polyester fabric.

10. A cap according to claim 1, wherein said cap band includes elastic yarns for permitting slight stretching thereof to increase the comfort of the cap during wear.

11. A cap comprising:

(a) a cap band defining a cap base;

(b) a crown attached to said cap band, and having a generally upstanding front portion shaped to fit against the forehead of a wearer and a generally sloping back portion, the front portion of said crown defining a relatively flat display surface for displaying a logo;

(c) size-adjustment means comprising first and second spaced-apart tabs attached respectively to the cap band at the front portion of said crown and including respective fastener members, and a removable adjustment strap located between the first and second tabs and including complementary fastener members at opposite ends thereof for being mated with the fastener members of the first and second tabs; and (d) the front portion of said crown defining an open area thereof adjacent to the first and second tabs and adjustment strap for permitting ready attachment and removal of the adjustment strap by the wearer;

(e) a support panel located adjacent to the front portion of said crown on an inside surface thereof for supporting the front portion in a generally upstanding position during cap wear, and having an arcuate bottom edge portion thereof residing adjacent to the open area formed in the front portion of said crown; and (f) a bill attached to the back portion of said crown opposite the strap opening, and residing adjacent to a back of the wearer's neck during wear.

12. A cap according to claim 11, wherein an angle defined between the cap bill and the front portion of the crown is between 90–110 degrees.

13. A cap according to claim 12, wherein an angle defined between the cap bill and the back portion of the crown is between 120–140 degrees.

* * * * *